US011219318B2

(12) United States Patent
Breen

(10) Patent No.: US 11,219,318 B2
(45) Date of Patent: Jan. 11, 2022

(54) COMFORT APPARATUS FOR A MOTHER AND AN INFANT

(71) Applicant: Irene Breen, Ballynahinch (GB)

(72) Inventor: Irene Breen, Ballynahinch (GB)

( * ) Notice: Subject to any disclaimer, the term of this patent is extended or adjusted under 35 U.S.C. 154(b) by 0 days.

(21) Appl. No.: 16/979,336

(22) PCT Filed: Mar. 11, 2019

(86) PCT No.: PCT/EP2019/056061
§ 371 (c)(1),
(2) Date: Sep. 9, 2020

(87) PCT Pub. No.: WO2019/170921
PCT Pub. Date: Sep. 12, 2019

(65) Prior Publication Data
US 2021/0000266 A1 Jan. 7, 2021

(30) Foreign Application Priority Data
Mar. 9, 2018 (GB) ..... 1803845

(51) Int. Cl.
*A47D 13/08* (2006.01)
*A47C 20/02* (2006.01)

(52) U.S. Cl.
CPC ..... *A47D 13/08* (2013.01); *A47C 20/027* (2013.01); *A47D 13/083* (2013.01); *A47C 20/025* (2013.01)

(58) Field of Classification Search
CPC .... A47D 13/08; A47D 13/083; A47C 20/025; A47C 20/027
USPC ..... 5/655, 657, 652, 632, 631, 930
See application file for complete search history.

(56) References Cited

U.S. PATENT DOCUMENTS 4,506,396 A 3/1985 Ritchie, Jr. et al.
4,617,691 A * 10/1986 Monti ..... A47C 7/383 128/DIG. 23
5,522,104 A 6/1996 Little
5,528,785 A 6/1996 Petrus
6,708,354 B1 3/2004 Carter et al.
7,213,281 B2 * 5/2007 Hahn ..... A47D 9/00 128/845

(Continued)

FOREIGN PATENT DOCUMENTS

CA 2505699 A1 * 10/2006 ..... A47C 20/027
CN 203168670 9/2013

(Continued)

OTHER PUBLICATIONS

UK Search Report dated Jul. 5, 2018.

(Continued)

*Primary Examiner* — Robert G Santos
(74) *Attorney, Agent, or Firm* — Preston Smirman; Smirman IP Law, PLLC

(57) ABSTRACT

A comfort apparatus for use by a parent and an infant. The comfort apparatus has a parent support and comfort arrangement and an infant portion. The parent support and comfort means is operable to support at least part of the back of an individual when the individual is lying laterally. The infant portion can support an infant. The parent support and comfort arrangement and the infant portion are joined or are adapted to be joinable to one another.

20 Claims, 8 Drawing Sheets

(56) References Cited

U.S. PATENT DOCUMENTS

| | | | | |
|---|---|---|---|---|
| 7,886,381 | B2 * | 2/2011 | Aiken | A47C 20/025 5/632 |
| 8,136,186 | B1 | 3/2012 | Leach | |
| 8,381,333 | B2 * | 2/2013 | Friedman | A47D 7/04 5/95 |
| 8,863,334 | B2 * | 10/2014 | Gibbons | A47C 20/027 5/632 |
| 9,265,357 | B2 * | 2/2016 | Fang | A47G 9/10 |
| 9,307,842 | B2 * | 4/2016 | Gibbons | A47C 20/025 |
| 9,775,452 | B2 * | 10/2017 | Gibbons | A47C 20/025 |
| 2004/0060117 | A1 | 4/2004 | Chan | |
| 2005/0283915 | A1 * | 12/2005 | Hahn | A47D 13/08 5/655 |
| 2006/0075563 | A1 | 4/2006 | Bartner et al. | |
| 2010/0175192 | A1 * | 7/2010 | Aiken | A47C 20/021 5/632 |
| 2012/0246824 | A1 * | 10/2012 | Friedman | A47D 7/04 5/95 |
| 2014/0215719 | A1 * | 8/2014 | Gibbons | A47C 20/021 5/632 |
| 2015/0040320 | A1 * | 2/2015 | Gibbons | A47C 20/025 5/632 |
| 2015/0067966 | A1 | 3/2015 | Gibbons et al. | |
| 2015/0101125 | A1 * | 4/2015 | Fang | A47D 13/083 5/655 |
| 2020/0288893 | A1 * | 9/2020 | Emdadi | A47G 9/1081 |
| 2021/0000266 | A1 * | 1/2021 | Breen | A47C 20/021 |

FOREIGN PATENT DOCUMENTS

| | | |
|---|---|---|
| CN | 104757845 | 7/2015 |
| JP | 2013052094 | 3/2013 |
| KR | 20130025065 | 3/2013 |
| WO | 2013120177 | 8/2013 |

OTHER PUBLICATIONS

English Abstract of JP2013052094.
English Abstract of CN203168670.
English Abstract of KR20130025065.
English Abstract of CN104757845.
International Search Report dated Jun. 24, 2019.
Written Opinion of the International Searching Authority dated Jun. 24, 2019.
International Preliminary Report on Patentability dated May 28, 2020.

* cited by examiner

COMFORT APPARATUS FOR A MOTHER AND AN INFANT

CROSS-REFERENCE TO RELATED APPLICATION

The instant application is a national phase of PCT International Application No. PCT/EP2019/056061 filed Mar. 11, 2019, and claims priority to GB Patent Application Serial No. 1803845.5 filed Mar. 9, 2018, the entire specifications of both of which are expressly incorporated herein by reference.

The present invention relates to a comfort apparatus. In particular, a comfort apparatus for a mother and an infant.

Lateral breastfeeding, wherein a mother and an infant lie beside each other for breastfeeding is often desirable, particularly when it is required to regularly feed an infant during nighttime. Lateral breastfeeding occurs globally but can be uncomfortable for the mother and even unsafe, for example, if the mother falls asleep and is at risk of rolling towards the infant. It is especially unsafe for a mother to bring an infant into their bed as there is no barrier to prevent the parent from rolling onto the infant, and nothing to prevent the infant from falling off the edge of the bed. Sleeping pods, which consist of a surface on which the infant can lie, surrounded by a cushioned barrier, are commercially available. These can be lifted onto the mattress of a bed and the barrier works to prevent the infant from easily rolling or being accidentally pushed out of the pod. The barriers also work somewhat to prevent a parent from rolling over and onto the infant although, in most cases, these barriers are not particularly large and it is still possible for a parent to roll over the barrier and onto the pod. Further, the barriers are often a closed, continuous barrier that extends around the perimeter of the pod. As such, the barrier can prevent comfortable breastfeeding as the mother cannot easily position herself near enough to the infant and it is often the case that parents have to lift the infant out of the pod completely to breastfeed.

Another safety solution is provided by a crib which has only three walls or a removable wall such that the crib can be adapted to a three-walled crib. This crib can be positioned against the side of a bed and the missing wall enables the mother to get close to the infant. The remaining walls prevent the parent from rolling onto the crib but they can also prevent the mother from getting close enough to the infant for comfortable breastfeeding. Further, if the crib is not height adjustable, the infant may be too high or too low relative to the parent's mattress.

There are no comfort apparatuses designed to facilitate lateral breastfeeding that offer support to both the parent and infant. When lateral breastfeeding the mother must ideally be retained on her side and, to an extent, curled around the infant. The previous solutions do not enable this. Whilst the previously described sleeping pods provide support and safety to an infant they do not retain a mother on her side to breastfeed. To provide support, a mother can position and prop pillows around herself but these inevitably will move over time and may cause discomfort. It is therefore desirable to have an apparatus that is configured to optimise safety and comfort for both the mother and infant.

A further disadvantage with comfort apparatuses that facilitate lateral breastfeeding is that they are typically only required during the period when an infant is requiring attention and feeding throughout the night. It is often not cost effective for a parent to purchase products with such limited usability. It would be desirable, therefore, to have a multi-functional comfort apparatus, having additional uses beyond providing support for lateral breastfeeding.

It is an object of the invention to mitigate or obviate the problems associated with comfort, safety and limited functionality of comfort apparatuses that facilitate lateral breastfeeding.

According to a first aspect of the invention there is provided a comfort apparatus for use by a parent and an infant, the comfort apparatus comprising a parent support and comfort means and an infant portion, the infant portion comprising an infant support and safety means, wherein in use the infant support and safety means can support an infant and prevents the infant from falling out of the comfort apparatus and the parent support and comfort means supports and provides comfort to the parent.

By "infant" we mean any baby and use of the apparatus is not restricted by the age of the infant/baby.

Advantageously, the comfort apparatus provides support and comfort to both the infant and the adult.

Ideally, the parent support and comfort means being operable to support at least part of the head and/or back of an individual when the individual is lying laterally.

Preferably, the parent support and comfort means is operable to support the back of an individual by extending along at least a part of the individual's back when the individual is lying laterally.

By "lying laterally" we mean lying on their side.

Advantageously, this props the user onto their side and prevents them from easily rolling onto their back. This is particularly advantageous when the user is laterally breastfeeding.

Ideally, the parent support and comfort means is sized such that it is operable to support both the head and legs of an individual simultaneously.

Ideally, the parent support and comfort means is sized such that it is operable to support the head of an individual and to extend from at or about the head of the individual to between the legs, most preferably between the knees, of the individual.

Advantageously, the parent support and comfort means provides both head and leg support, thereby enhancing the overall comfort of the user.

Preferably, the comfort apparatus, most preferably the infant portion, comprising a barrier.

Advantageously, in use, the barrier prevents the parent from rolling onto the infant.

Preferably, the barrier being removable.

Advantageously, if the mother thinks it is unlikely that she will fall asleep while laterally breastfeeding, she may choose to remove the barrier thereby enabling her to lie with the infant without the barrier extending therebetween. Removing the barrier can also make the barrier easier to clean.

Ideally, in use, the parent support and comfort means supports the back of an adult when lying laterally.

Ideally, the parent support and comfort means and the barrier being arranged defining a space therebetween, the space being sized to accommodate an adult.

Preferably, the space between the parent support and comfort means and the barrier being adjustable.

Advantageously, the dimensions of the comfort apparatus can be adjusted.

Ideally, the space between the parent support and comfort means and the barrier being optimum regarding comfort and support for breastfeeding of an infant by a mother using the comfort apparatus.

Preferably, the barrier and the infant support and safety means being spaced apart defining a space therebetween.

Ideally, the space between the barrier and the infant support and safety means being optimum for supporting and comforting an infant.

Ideally, in one embodiment, the space between the barrier and infant support and safety means being variable.

Preferably, the parent support and comfort means and the infant support and safety means define an outer perimeter of the comfort apparatus.

Ideally, the distance between the parent support and comfort means and the infant support and safety means being adjustable such that the perimeter of the comfort apparatus can be modified.

Ideally, the comfort apparatus being sized to be supported on a mattress.

Advantageously, the parent support and comfort means enables a set of parents and an infant to sleep comfortably and safely on the same bed; the parent support and comfort means providing a barrier between the parents.

Preferably, the comfort apparatus being adaptable for use as a headrest, leg-rest, footrest and/or pregnancy pillow.

Ideally, the parent support and comfort means being soft.

Preferably, the parent support and comfort means being resilient.

Ideally, the parent support and comfort means comprising an elongate cushion apparatus.

Advantageously, the elongate cushion apparatus can be used as a pregnancy pillow. This enables the comfort apparatus to be used by a pregnant woman until after birth of the child and up until there is no longer any requirement for lateral breastfeeding.

Ideally, the parent support and comfort means being modifiable.

Preferably, the elongate cushion apparatus being modifiable such that the total length of the elongate cushion apparatus can be altered.

Advantageously, reducing the total length of the elongate cushion apparatus can make it suitable for use as a support for an infant for sitting upright, aged 8+ months, wherein the infant may be placed between mutually opposing portions of the elongate cushion apparatus. Advantageously again, increasing the length of the parent support and comfort means can enhance comfort for taller users and make it suitable for use as a pregnancy pillow.

Ideally, in at least one configuration, the elongate cushion apparatus is shaped to provide a head support and back support for a mother, for example, wherein the elongate cushion apparatus extends along a portion of at least the upper back of the user in use.

Ideally, the length of the elongate cushion apparatus being modifiable by removing a portion of the elongate cushion apparatus to shorten the length.

Preferably, the length of the elongate cushion apparatus being modifiable by adding an extending portion on to the elongate cushion apparatus to increase the length.

Ideally, the comfort apparatus being modular.

Preferably, the comfort apparatus, most preferably the parent support and comfort means, comprising rearrangeable modules.

Ideally, the parent support and comfort means being modular.

Preferably, the elongate cushion apparatus being modular.

Ideally, the elongate cushion apparatus comprising rearrangeable modules.

Advantageously, removing or adding a module to the elongate cushion apparatus adjusts the total length of the elongate cushion apparatus.

Preferably, the elongate cushion apparatus comprising a first end and a second end.

Ideally, the elongate cushion apparatus comprising a middle section, a first end section and a second end section.

Preferably, the first end section and the second end section being connectable to the middle section via releasable fixing means such as a zip, buttons, hook-and-eye arrangements, adhesives and/or pins.

Ideally, the elongate cushion apparatus comprising a means for concealing the connections between first end section, second end section and the middle section.

Ideally, the means for concealing the connections comprising a section of fabric.

Preferably, the section of fabric extending from the first end section, second end section and/or the middle section.

Preferably, the first end section terminating in the first end and the second end section terminating in the second end.

Preferably, the first end section and/or the second end section being separable from the middle section.

Preferably, at least one section, most preferably the middle section, of the elongate cushion apparatus being suitable for use as a support for an infant when a mother is breastfeeding the infant in the underarm/rugby ball hold.

Advantageously, this provides a further use of the comfort apparatus.

Ideally, the first end section being connectable to the second end section.

Advantageously, the first end section and the second end section can be removed from the middle section and then the first end section can be connected to the second end section.

Preferably, the first end section being connectable to the second end section via a zip, buttons, hook-and-eye arrangements, adhesives and/or pins.

Preferably, when connected, the first end section and the second end section form a substantially arcuate shape.

Advantageously, the substantially arcuate shape can used to support an infant sitting in an upright position as a baby lounger. It can further be used as a breastfeeding pillow when the infant is developing their first latch aged 0+ months, wherein the first end section second end section are placed around the abdomen of the mother and the infant is support and the first or second end section during breastfeeding.

Ideally, the middle section being elongate.

In one embodiment, the middle section being modular such that middle-section modules can be removed or added to alter the dimensions of the elongate cushion apparatus.

Preferably, the middle section being substantially linear.

Ideally, the middle section being cylindrical, triangular prism-shaped, cuboid, or other suitable shape. Most preferably, the middle section being substantially cylindrical.

Preferably, the middle section terminating in a cross-section that is geometrically similar to the cross-section of the first end section and/or the second end section where the first end section and/or second end section are connectable to the middle section.

Ideally, the first end section and/or the second end section being curved such that a portion of the first end section and/or the second end section is substantially orthogonal to axis of the middle section when the first end section and/or the second end section are connected to the middle section respectively.

Preferably, the cross-sectional area of the first end section and/or the second end section being varied.

Ideally, the first end section and/or the second end section has a smaller cross-sectional area where the first end section and/or the second end section is/are connectable to the middle section and a larger cross-sectional area at the first end and/or the second end.

Preferably, the cross-sectional area of the first end section and/or the second end section increases from where the first end section and/or the second end section is/are connectable to the middle section to the first end and/or second end respectively.

Ideally, the first end and/or second end comprising a substantially elliptical cross-section.

Advantageously, this provides a greater degree of support and comfort at or near the first end or second end. In use, the first end or second end will support the head or legs of an adult.

Preferably, the barrier being located at, on, or integrally formed with, the infant portion.

Advantageously, the infant portion can be used to support the infant for "tummy time" wherein the infant is placed on their stomach for a period of time to develop crawling ability, generally when the infant is aged 4+ months.

Ideally, the infant portion being sized to accommodate most or all of the body of an infant lying on the infant portion.

Ideally, the infant portion being sized to accommodate the entire body of an infant aged at least 3 months, most preferably up to or about 18 months old.

Advantageously, the overall useable period of the comfort apparatus is approximately two years. This includes a period before birth wherein the comfort apparatus is used as a pregnancy pillow.

Preferably, the infant portion has a length of at least 400 mm, most preferably at least 600 mm.

Ideally, the infant portion has a width of at least 250 mm, most preferably at least 420 mm.

Ideally, the infant portion has a length of about 750 mm and a width of about 530 mm.

Ideally, the infant support and safety means being substantially wedge-shaped.

Preferably, the infant support and safety means being sized such that it can prevent a person, for example, the father of the infant, from rolling onto the infant portion.

Preferably, the infant support and safety means being substantially crescent shaped.

Ideally, the infant support and safety means comprising an upright portion.

Preferably, the upright portion being vertical or near-vertical.

Preferably, in use, the upright portion defining an outermost wall of the comfort apparatus.

Ideally, the upright portion being non-linear. Most preferably, the upright portion being arcuate.

Preferably, the upright portion having a varied height.

Preferably, the infant support and safety means having two opposing endpoints.

Ideally, the upright portion having its greatest height between the opposing endpoints of the infant support and safety means.

Preferably, the upright portion having its greatest height at or about midway between the opposing end points of the infant support and safety means.

Alternatively, the upright portion having its greatest height at one or both of the opposing end points of the infant support and safety means.

Ideally, the upright portion increasing in height from the upright portion end points.

Ideally, the infant support and safety means comprising a sloping portion extending downwards from the upright portion.

Preferably, the infant portion is operable to support an infant.

Ideally, the infant portion is sized such that the majority or an entirety of the body of the infant is supportable by the infant portion.

Ideally, the infant portion comprises a support mat for supporting the infant.

Preferably, the sloping portion extends downwards from the upright portion to the support mat.

Ideally, the upright portion and the sloping portion being formed together as a single unitary component.

Preferably, the infant support and safety means or a part thereof being removable form the infant portion.

Ideally, in use, an infant will be positioned between the infant support and safety means and the barrier, the sloping portion providing support and comfort to the infant.

Preferably, the comfort apparatus comprises one or more protective covers.

Ideally, the support mat being soft.

Ideally, the support mat comprising a cushioning layer.

Ideally, the infant portion and/or the parent support and safety means comprise removable/replaceable covers.

Advantageously, covers can be removed for washing and can be changed to for aesthetic preferences.

Preferably, the infant portion comprising a protective layer.

Preferably, the protective layer extends over at least part of the cushioning layer.

Ideally, the protective layer envelops the cushioning layer.

Preferably, the protective layer covers the infant support and safety means.

Ideally, the protective layer being shaped such that it is taut when it is fitted over the infant support and safety means and cushioning layer.

Preferably, the protective layer comprising a zip, button and/or a series of buttons or other releasable sealing or fixing means such that the protective layer can be releasably closed.

In one embodiment, the infant portion comprising a means for retaining the tautness of the protective layer.

Preferably, the means for retaining tautness comprising the protective layer being fixed to the infant support and safety means.

Ideally, the protective layer being fixed at or near the location of where the sloping portion meets the support mat.

Advantageously, the tautness of the protective layer prevents it from loosely ruffling or folding, which could, in some instances, produce a suffocation risk for an infant.

Ideally, the protective layer extending over the upright portion.

Ideally, the protective layer cover extending over the sloping portion.

In one embodiment, the protective layer comprising a plurality of detachable protective layer members that collectively cover the infant portion.

Ideally, the protective layer comprising soft fabric.

In one embodiment, the protective layer comprising a hydrophobic material.

Advantageously, the protective layer can be easily cleaned.

Preferably, the protective layer comprising an upper protective layer and a lower protective layer.

Ideally, the protective layer being in contact with the infant support and safety means.

Preferably, the upper protective layer being in contact with the infant support and safety means.

Ideally, the infant portion, most preferably the support mat, comprising an even surface.

Preferably, the infant portion having a circular, elliptical, oval, square or rectangular base.

Preferably, the support mat being circular, elliptical, oval, square or rectangular in shape.

Ideally, the infant portion, most preferably the support mat, being shaped such that the head of an infant is supported when the comfort apparatus is being used for feeding.

Preferably, in use, at least part of the support mat extends away from the barrier and substantially parallel to the elongate support apparatus.

Advantageously, this provides support for an infant around the barrier such that the barrier can be positioned between an infant and a mother but the head of the infant can be positioned sufficiently proximal to the mother to enable comfortable feeding.

Ideally, the infant portion having an edge defining a perimeter.

Advantageously, in use, a mother can curve around infant portion enabling the mother to comfortably breastfeed an infant.

Ideally, the infant support and safety means being shaped such that at least part of the infant support and safety means is aligned with the perimeter of the infant portion.

Preferably, the infant support and safety means being shaped such that the upright portion is aligned with the perimeter of the support mat.

In one embodiment, the infant support and safety means is integrally formed with the support mat.

Ideally, the barrier is upstanding.

Preferably, the infant portion, most preferably the support mat, has a planar surface and the barrier extends substantially orthogonally from the planar surface, most preferably from the support mat.

Preferably, the barrier being positioned at or near the opposing perimeter of the infant portion to that of the perimeter adjacent to the location of the infant support and safety means.

Ideally, the barrier being substantially rigid.

Advantageously, in use, this prevents a person from rolling over the barrier and the barrier can thereby separate an infant lying on the infant portion from its parent for safety.

In one embodiment, the barrier being formed with the support mat.

Ideally, the barrier comprising a barrier support means.

Preferably, the barrier support means provides form and rigidity to the barrier.

Ideally, the barrier support means being located at least partially within the support mat.

Preferably, the barrier support means comprising a base portion.

Ideally, the base portion is a flat portion.

Ideally, the base portion resting on the protective layer, most preferably, on the lower protective layer of the support mat.

Preferably, the barrier support means comprising an upwardly extending portion that extends upwardly from the base portion.

Ideally, the upwardly extending portion extending substantially orthogonally from the planar surface of the infant portion.

Ideally, the upwardly extending portion extending substantially orthogonally from the surface of the base portion.

Preferably, the upwardly extending portion being integrally formed with the base portion.

In one embodiment, the upwardly extending portion being solid.

In another embodiment, the upwardly extending portion being substantially hollow.

Ideally, the upwardly extending portion comprising a height, width and depth.

Preferably, the upwardly extending portion comprising a first face section and a second face section.

Ideally, the first and second face sections are mutually opposing defining a space therebetween.

Ideally, the upwardly extending portion comprising a side section extending between the first and second face sections.

Ideally, the side section extending upwards from the base portion and having mutually opposing portions defining a space therebetween.

Ideally, the first face section and/or the second face section being spaced apart from the base portion, supported by the side section.

Preferably, the first face section and/or the second face section extending from the side section.

Preferably, the first face section and/or the second face section are formed extending from the side section but not from the base portion, thereby defining a space between the first face section and/or second face section and the base portion.

Advantageously, the space between the first face section and/or second face section and the base portion can be used to locate the barrier support means within the infant portion, specifically, within the cushioning layer.

Preferably, the comfort apparatus comprising a means for locating the barrier support means.

Ideally, the infant portion comprising a means for locating the barrier support means thereon.

Preferably, the means for locating the barrier support means is operable to locate the barrier relative to the infant portion, the support mat and/or the parent support and comfort means.

Advantageously, the means for locating the barrier support means locates the barrier support means in a lateral and vertical direction.

Preferably, at least part of the means for locating the barrier support means being disposed on the protective layer.

Ideally, at least part of the means for locating the barrier support means being disposed on the lower protective layer.

Ideally, at least part of the means for locating the barrier support means being disposed between the lower protective layer and the cushioning layer.

Preferably, at least part of the means for locating the barrier support means comprising a retaining arrangement such as a strap, pocket or hook-and-loop fasteners operable to receive and/or retain at least a part of the barrier support means.

Ideally, the retaining arrangement being operable to retain the barrier support means on the infant portion.

Preferably, the retaining arrangement being located on the cushioning layer and/or protective layer.

Ideally, the retaining arrangement being connected to the protective layer, most preferably, to the lower protective layer.

Preferably, wherein the retaining arrangement is a strap or pocket, the strap or pocket being sized to receive a part of the barrier support means.

Ideally, the strap or pocket being sized to receive the flat portion of the barrier support means.

Preferably, the means for locating the barrier support means prevents the barrier support means from being moved substantially vertically and/or horizontally.

Ideally, the means for locating the barrier support means comprises an interlock between the cushioning layer and the barrier support means.

Preferably, the means for locating the barrier support means comprises part of the cushioning layer extending through the upwardly extending portion of the barrier support means.

Preferably, the means for locating the barrier support means comprises part of the cushioning layer extending through the upwardly extending portion, between the plane of the flat portion and below the first face section and/or second face section.

Ideally, the flat portion being located below the cushioning layer in use.

Preferably, the flat portion being located between the cushioning layer and the protective layer, most preferably, between the cushioning layer and the lower protective layer.

Advantageously, in use, the cushioning layer is located above the flat portion and provides a cushion between the flat portion and an infant.

Ideally, the barrier is wider at its base than at an upper portion.

Advantageously, this form provides an optimal tradeoff between functionality as a barrier between the mother and infant in use, while still allowing the mother to comfortably access the infant for breastfeeding.

Preferably, the barrier comprising a fin-shaped form.

Ideally, the barrier support means provides a fin-shaped form to the barrier.

Ideally, the barrier support means comprises apertures or cut-outs.

Preferably, the barrier support means comprising a perforated material.

Advantageously, this reduces the amount of material required to provide support to the barrier.

Ideally, the barrier support means comprising plastic.

In one embodiment, the fin-shaped form being substantially hollow. Advantageously, this reduces the amount of material required to provide support to the barrier.

Ideally, the cushioning layer being shaped to accommodate the barrier support means.

Preferably, the cushioning comprising one or more grooves for accommodating the barrier support means.

In one embodiment, the cushioning layer comprising an aperture for accommodating the barrier support means.

Preferably, the comfort apparatus comprising a barrier support means cover.

Ideally, the barrier comprising a barrier support means cover.

Preferably, the barrier support means cover comprising a soft material located over and enclosing the barrier support means.

Ideally, the protective layer of the support mat extending over the barrier support means.

Preferably, the protective layer of the support mat extending over the barrier support means cover.

Preferably, the barrier support means cover being formed from a material similar to the material of the cushioning layer.

Ideally, the support mat being separable from the parent support and comfort means.

Ideally, the parent support and comfort means and the infant portion are joined.

By "joined" we mean either the parent support and comfort mean and the infant portion are manufactured as two separate components that are then connected, fixed, attached, fastened, adhered, glued, fused or knitted together, or that the parent and support and comfort means and the infant portion are integrally formed as one continuous piece and are seamlessly connected.

Ideally, the parent support and comfort means and the infant portion are adapted to be joinable, most preferably releasably joinable, to one another.

Preferably, the parent support and comfort means and the infant support and safety means are joinable, most preferably releasably joinable, to one another.

Advantageously, when joined, this prevents the infant support and safety means and the parent support and comfort means moving away from one another. Therefore, in use, the mother and infant remain in a predetermined position relative to each other. If the comfort apparatus is being used on a mattress, for example, the weight of the mother effectively anchors and retains the infant portion in place on the mattress. This mitigates the risk that the infant portion could fall off the mattress.

Preferably, the comfort apparatus comprising a joining means for joining, most preferably releasably joining, the parent support and comfort means and the infant portion together.

Ideally, the joining means extends underneath the parent when the comfort apparatus is in use.

Preferably, at least part of the joining means is formed as a sheet or blanket.

Advantageously, sheets and blankets are relatively thin and this enhances comfort as the joining means is discrete and does not obstruct the parent when lying on the joining means.

Ideally, the joining means being operable to join the infant support and safety means to the parent support and comfort means.

Ideally, the joining means is adjustable such that the distance between the parent support and comfort means and the infant portion, most preferably the infant support and safety means, can be adjusted.

Advantageously, the mother can configure the comfort apparatus such that her back is supported by the elongate cushion apparatus and such that the barrier is located proximal to her abdomen. This is the optimal configuration as the barrier provides safety for the infant and the elongate cushion apparatus provides back support for the mother.

Preferably, the support mat and the parent support and comfort means are releasably joinable to one another.

Ideally, the support mat and the parent support and comfort means being joinable by the joining means.

Advantageously, the joining means prevents the support mat and the parent support and comfort means from moving substantially apart when in use.

In one embodiment, the barrier and/or the barrier support means is disposed on the joining means.

Preferably, the joining means comprises a joining mat.

Ideally, the joining mat is connectable, most preferably releasably connectable, to the parent support and comfort means and/or the infant support and safety means.

Alternatively, the joining mat may be fixedly connected to the parent support and comfort means and/or the infant portion.

Preferably, the joining mat can be arranged extending between the parent support and comfort means to the infant portion.

Ideally, the joining mat is connectable, most preferably releasably connectable, to the infant portion, most preferably to the support mat.

Preferably, the joining mat is connectable, most preferably releasably connectable, to the underside of the infant portion, most preferably to the underside of the support mat.

Ideally, in use, the adult lays on top of the joining mat.

Preferably, the infant portion and/or the parent support and comfort means are joined to the joining means via a zip, buttons, snap buttons or fasteners, hook-and-eye arrangements, adhesives and/or pins.

Ideally, the distance between the infant portion and the parent support and comfort means can be altered by altering where on the joining means the infant portion and/or the parent support and comfort means are connected.

Ideally, the distance between the infant portion and the parent support and comfort means can be adjusted by folding the joining means under the infant portion and/or under the parent support and comfort means.

Preferably, the joining mat being capable of being rolled such that it can be rolled for storage.

Preferably, the joining means or joining mat is suitable for use a privacy cover when breastfeeding.

Ideally, the joining means or joining mat being formed from a substantially opaque material and being sized to cover an infant during breastfeeding.

Ideally, the joining means or joining mat being adapted to be releasably fixable to the mother, for example, around the mother's neck, such that it can be used as a privacy cover when breastfeeding.

Preferably, the joining means or joining mat comprising a neck strap such that it can be used as a cover when breastfeeding.

Advantageously, this provides an additional use for the comfort apparatus.

Ideally, at least part of the width of the joining means or joining mat is substantially equal to the width of a part of the infant portion.

Ideally, the width of the joining means or joining mat at or about where it joins to the infant portion is substantially equal to the width of the infant portion at or about the perimeter edge of the infant portion that faces the parent support and comfort means in use when the joining means or joining mat is joined to both the infant portion and the parent support and comfort means.

Advantageously, this is aesthetically desirable and, where the joining means joining mat is joined to the infant portion along all or substantially all its width, provides a secure connection between the infant portion and the joining means and joining mat.

Ideally, a portion of the joining mat at or about a terminal portion of the mat is shaped to correspond to the shape of the base of the infant support and safety means.

Advantageously, when the joining mat is attached to the infant portion in at least one configuration it conforms to the shape of the infant support and safety means and does not extend beyond the base of the infant support and safety means. This is aesthetically desirable and obviates a surplus of material being used during manufacture.

Ideally, the comfort apparatus comprising a storage means.

Ideally, the storage means is for storage of items such as muslins, toys and other items.

Preferably, the storage means comprising a pocket or pockets.

Ideally, the storage means comprising a zipped pocket.

Preferably, the storage means comprising a pocket closable with buttons.

Ideally, the storage means being provided on the parent support and comfort means, infant support and safety means and/or the barrier.

Ideally, the pocket being attached to the parent support and comfort means at a plurality of points.

Ideally, the pocket being attached to the parent support and comfort means at a plurality of spaced apart points.

Advantageously, by connecting the pocket to the parent support and comfort means at a plurality of points, the pocket does not excessively sag away from the parent support and comfort means.

According to a second aspect of the invention there is provided a parent support and comfort means for supporting a mother lying laterally for breastfeeding, the parent support and comfort means being adaptable for use as part of a comfort apparatus for a mother and an infant.

Ideally, the parent support and comfort means is adapted to be joinable, most preferably, releasably joinable to an infant portion of a comfort apparatus.

Ideally, the parent support and comfort means is adapted to be joinable, most preferably, releasably joinable to an infant portion of a comfort apparatus at least partially via a joining means.

Alternatively, the parent support and comfort means comprising a joining means extending from the parent support and comfort means and being operable to join with an infant portion of a comfort apparatus for a mother and an infant.

According to a third aspect of the invention there is provided an infant portion of a comfort apparatus, the infant portion being adaptable for use as part of a comfort apparatus for a mother and an infant.

Advantageously, the infant portion can be used as a night time breastfeeding pod, wherein the infant portion is lifted into the mother's bed.

Preferably, the infant portion comprising a support mat for supporting an infant.

Ideally, the infant portion is adapted to be joinable, most preferably, releasably joinable to a parent support and comfort means.

Ideally, the infant portion is adapted to be joinable, most preferably, releasably joinable to a parent support and comfort means at least partially via a joining means.

Alternatively, the infant portion comprising a joining means extending from the infant portion and being operable to join with a parent support and comfort means of a comfort apparatus for a mother and an infant.

According to a fourth aspect of the invention there is provided a comfort apparatus for use by a parent and an infant, the comfort apparatus comprising a parent support and comfort means, the parent support and comfort means being operable to support at least part of the head and/or back of an individual when the individual is lying laterally, the comfort apparatus further comprising an infant portion for supporting an infant, and wherein the parent support and comfort means and the infant portion are joined or are adapted to be joinable to one another.

Ideally, the infant portion comprises an infant support and safety means.

Preferably, the infant support and safety means can support and infant and prevent the infant from falling out of the infant portion.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which shows by way of example only two embodiments of an apparatus in accordance with the invention.

Figure 1:
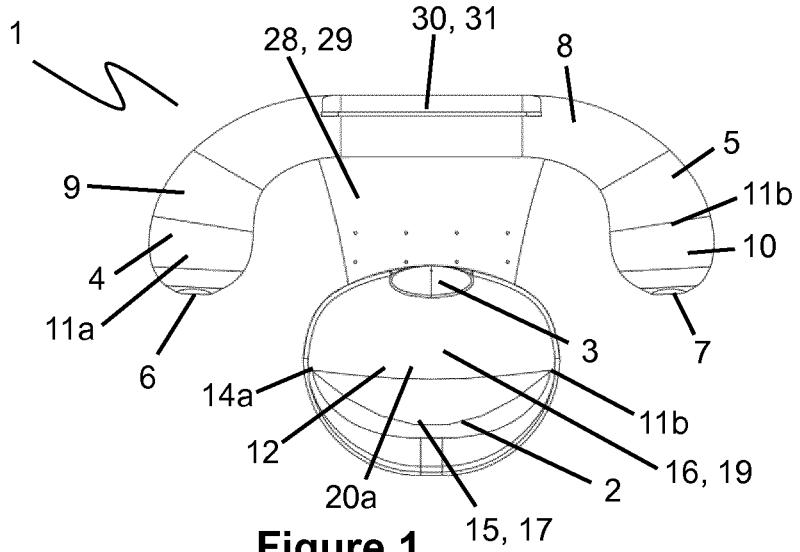
FIG. 1 is a plan view of a first embodiment of a comfort apparatus according to an aspect of the invention.
Figure 2:
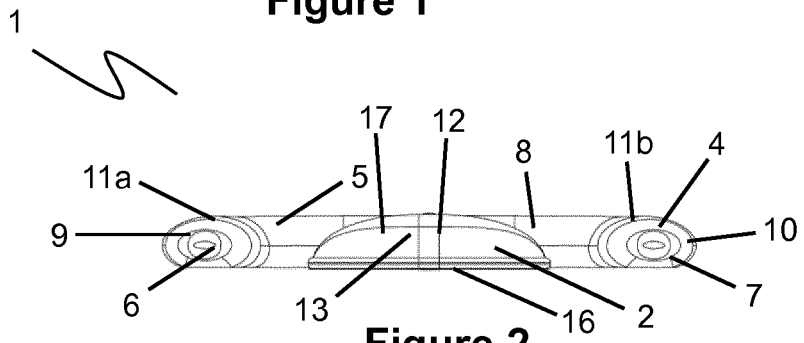
FIG. 2 is a side elevation view of the comfort apparatus of FIG. 1.
Figure 3:
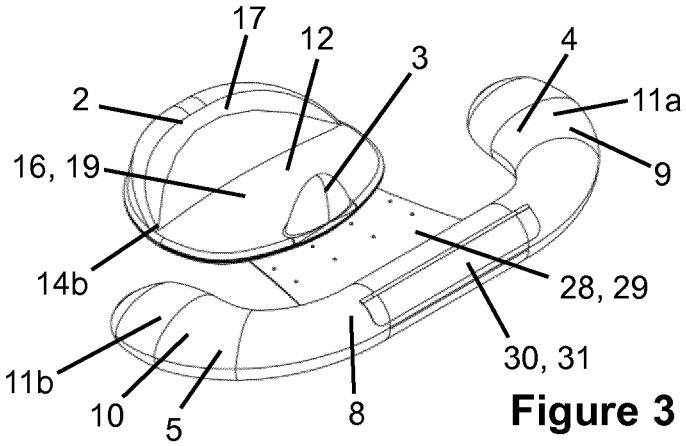
FIG. 3 is a perspective view of the comfort apparatus of FIG. 1.
Figure 4:
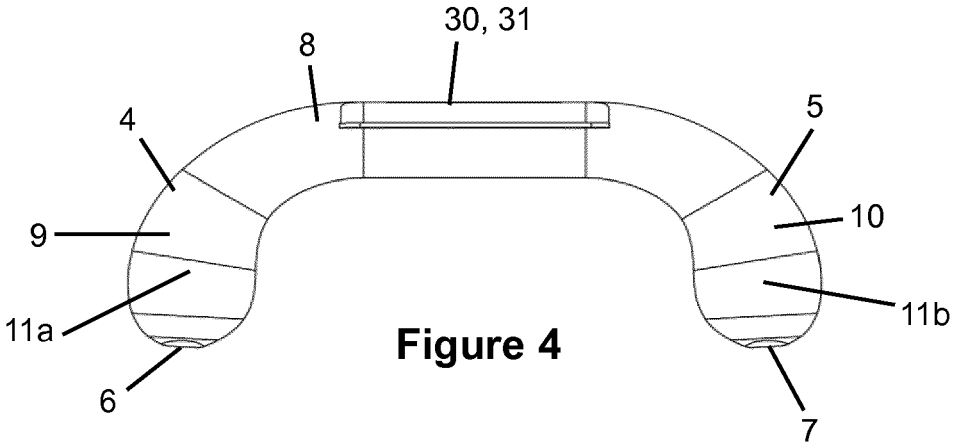
FIG. 4 is a plan view of the parent support and comfort arrangement of the comfort apparatus of FIG. 1.
Figure 5:
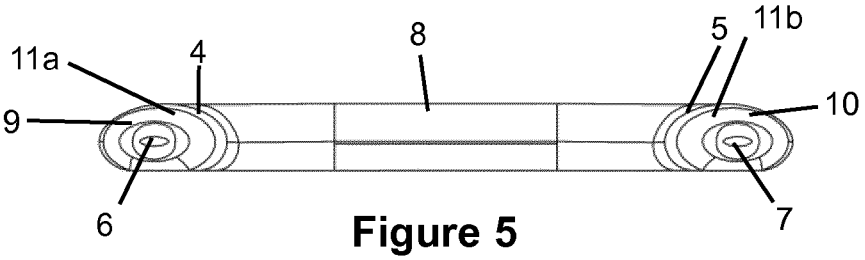
FIG. 5 is a side elevation view of the parent support and comfort arrangement of FIG. 4.
Figure 6:
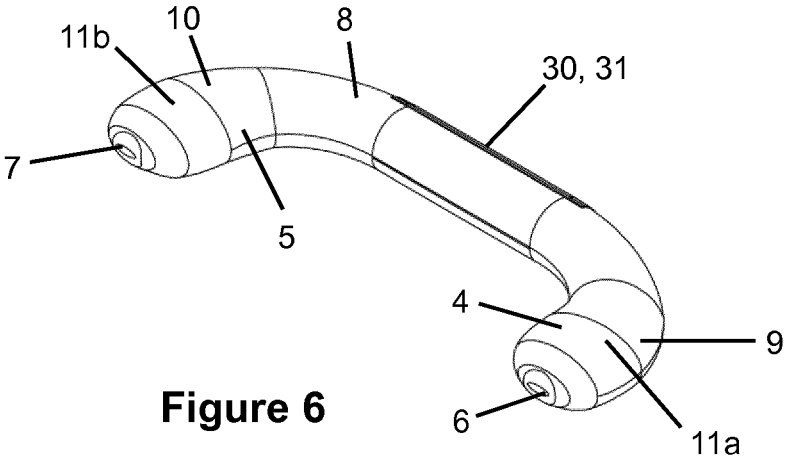
FIG. 6 is a perspective view of the parent support and comfort arrangement of FIG. 4.

In the FIGS. 1 to 14 there is shown a first embodiment of a comfort apparatus indicated generally by reference numeral 1. The comfort apparatus 1 has an infant support and safety arrangement 2, barrier 3 and a parent support and comfort apparatus 4. In use, the infant support and safety arrangement 2 supports an infant and prevents the infant from falling out of the comfort apparatus 1, the barrier 3 prevents the adult from moving substantially towards the infant, and the parent support and comfort apparatus 4 supports and comforts the adult when the adult is breast-feeding the infant. The parent support and comfort apparatus 4 supports the back of an adult when the adult is lying laterally. The comfort apparatus 1 is adaptable for use as a headrest, leg-rest, footrest and pregnancy pillow. The parent support and comfort apparatus 4 is soft and resilient and has an elongate cushion apparatus 5. The elongate cushion apparatus 5 is modifiable such that the length of the elongate cushion apparatus 5 can be modified by a user. Reducing the length of the elongate cushion apparatus 5 makes it suitable for use as a multi-functional pillow shown in FIGS. 7 to 9, adaptable to support an infant for breastfeeding, "tummy time" and for sitting upright.

Figure 7:
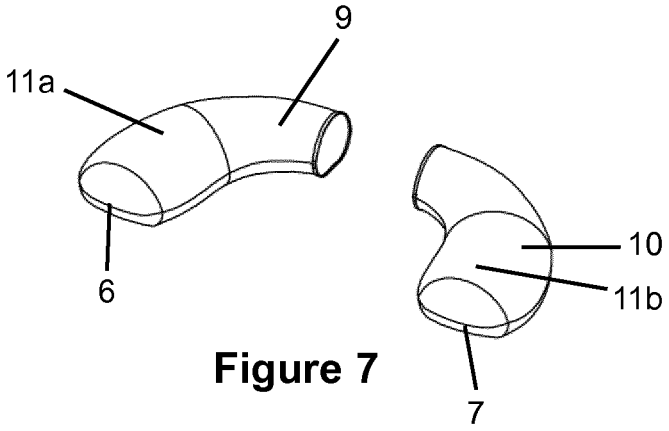
FIG. 7 is a perspective view of the first end section and the second section of the parent support and comfort arrangement of FIG. 4 shown detached from the middle section.
Figure 8:
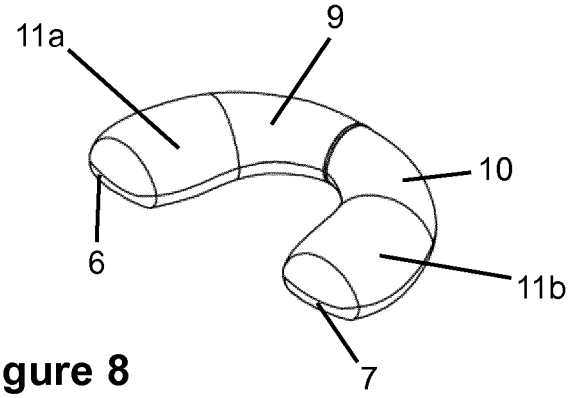
FIG. 8 is a perspective view of the first end section and the second section as shown in FIG. 7.
Figure 9:
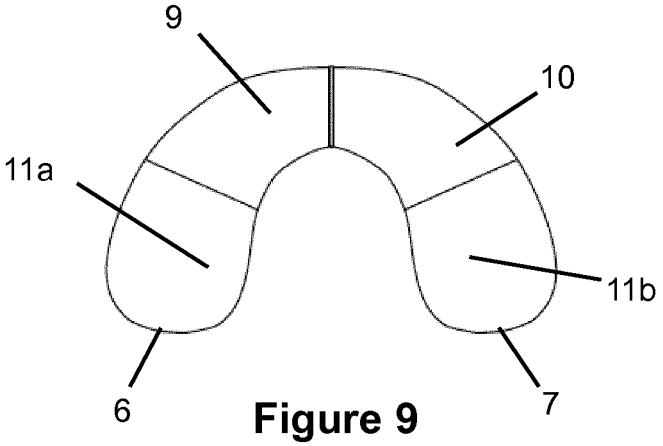
FIG. 9 is a plan view of the first end section and the second section of FIG. 8.
Figure 10:
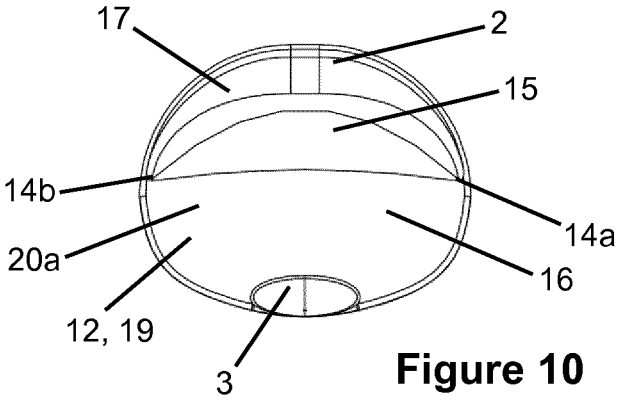
FIG. 10 is a plan view of the infant portion of the comfort apparatus of FIG. 1.
Figure 11:
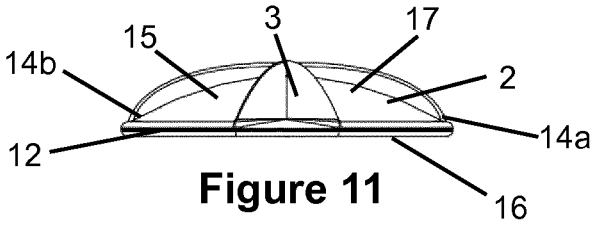
FIG. 11 is a side elevation view of the infant portion of FIG. 10.
Figure 12:
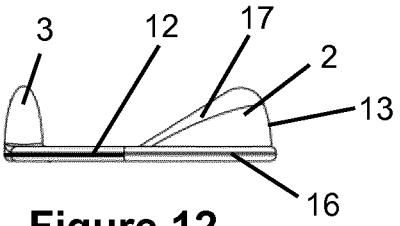
FIG. 12 is a front elevation view of the infant portion of FIG. 10.
Figure 13:
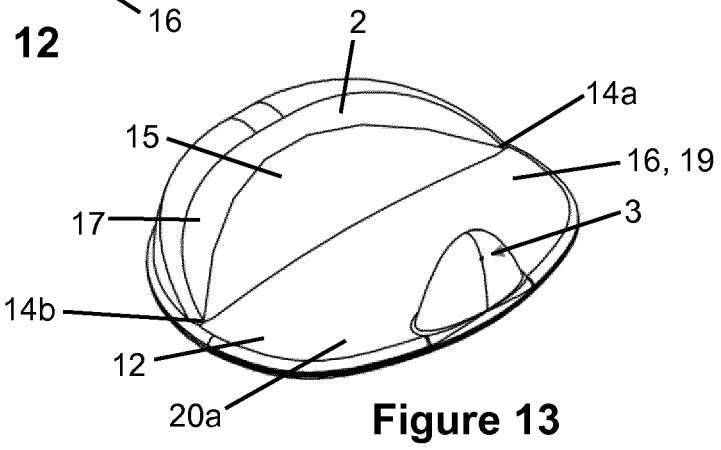
FIG. 13 is a perspective view of the infant portion of FIG. 10.
Figure 14:
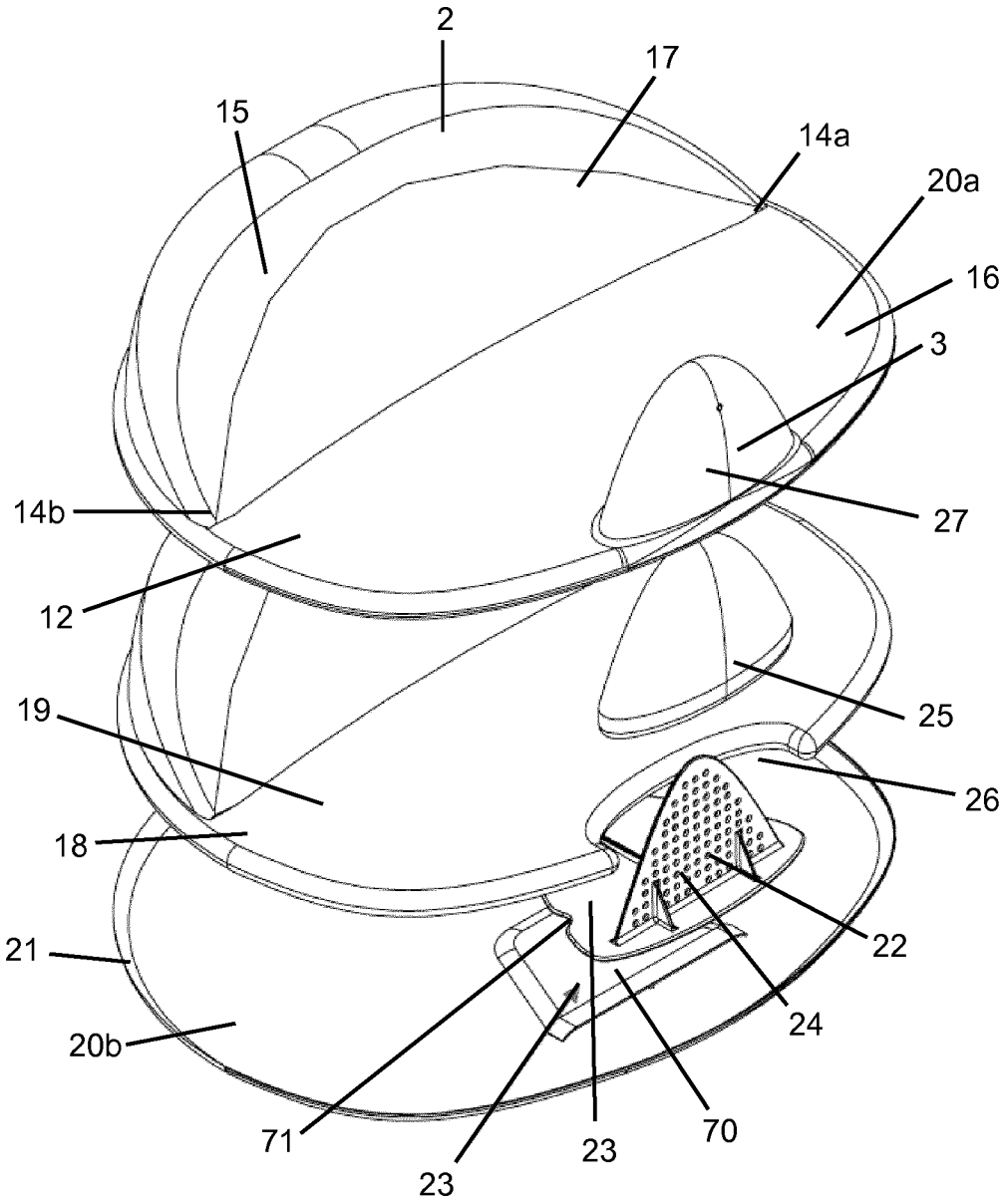
FIG. 14 is an expanded view of the infant portion of FIG. 10.
Figure 15:
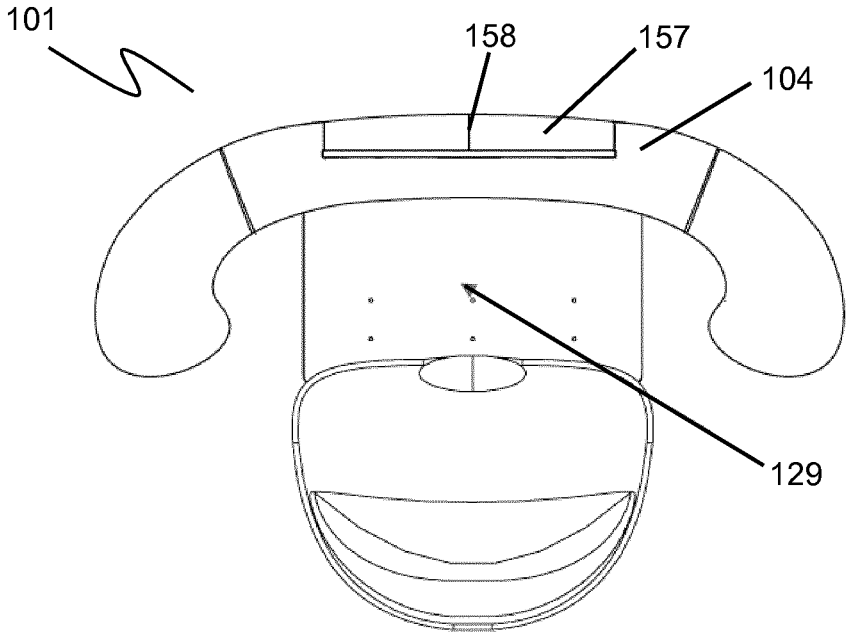
FIG. 15 is a plan view of a second embodiment of a comfort apparatus according to the invention.
Figure 16:
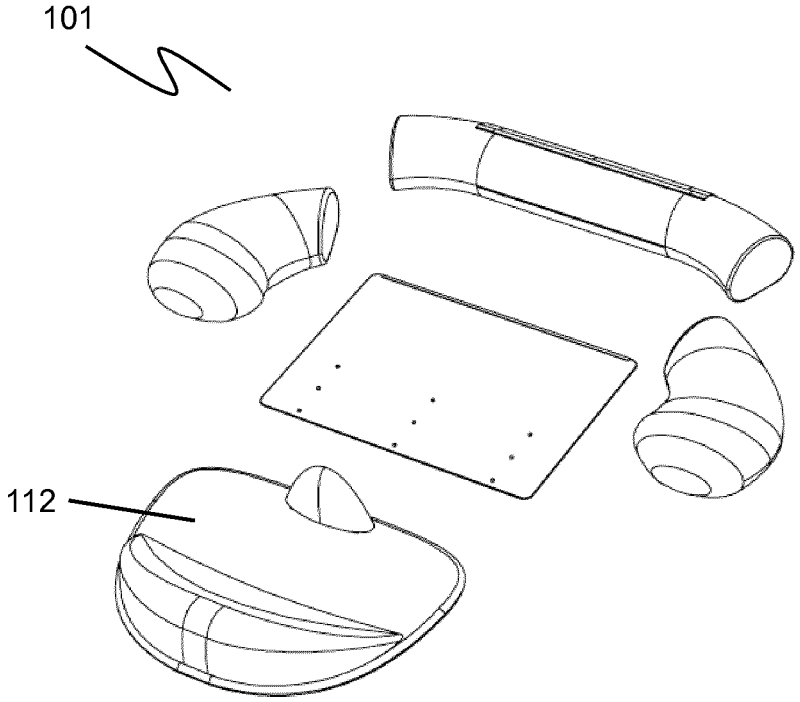
FIG. 16 is a perspective exploded view of the comfort apparatus in FIG. 15.
Figure 17:
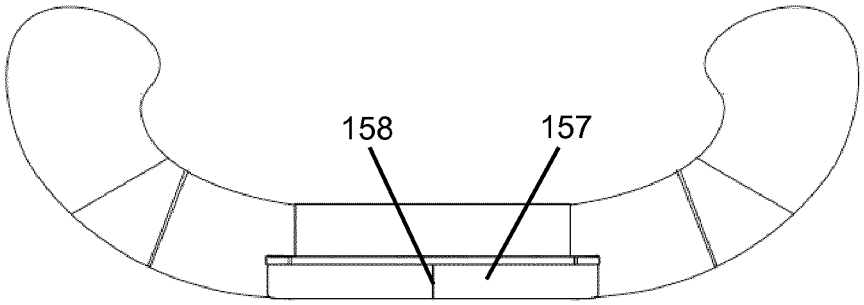
FIG. 17 is a plan view of the parent support and comfort arrangement of the comfort apparatus shown in FIG. 15.
Figure 18:
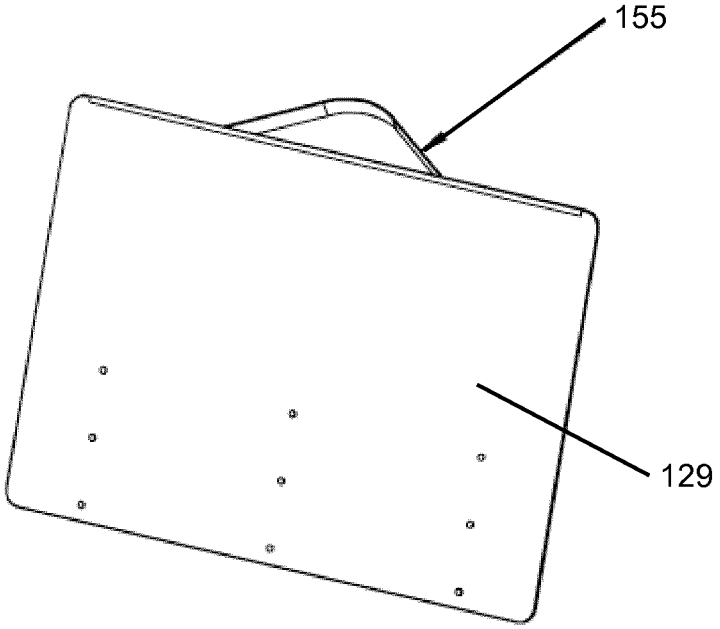
FIG. 18 is a perspective view of the joining arrangement of the comfort apparatus shown in FIG. 15.
Figure 19:
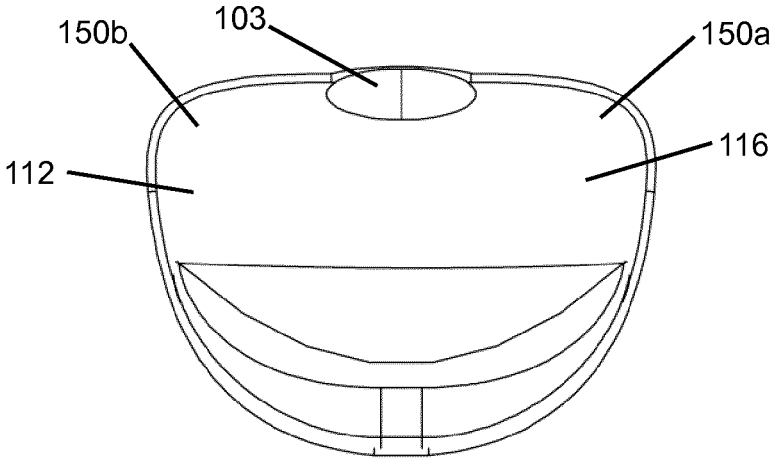
FIG. 19 is a plan view of the infant portion of the comfort apparatus of FIG. 15.
Figure 20:
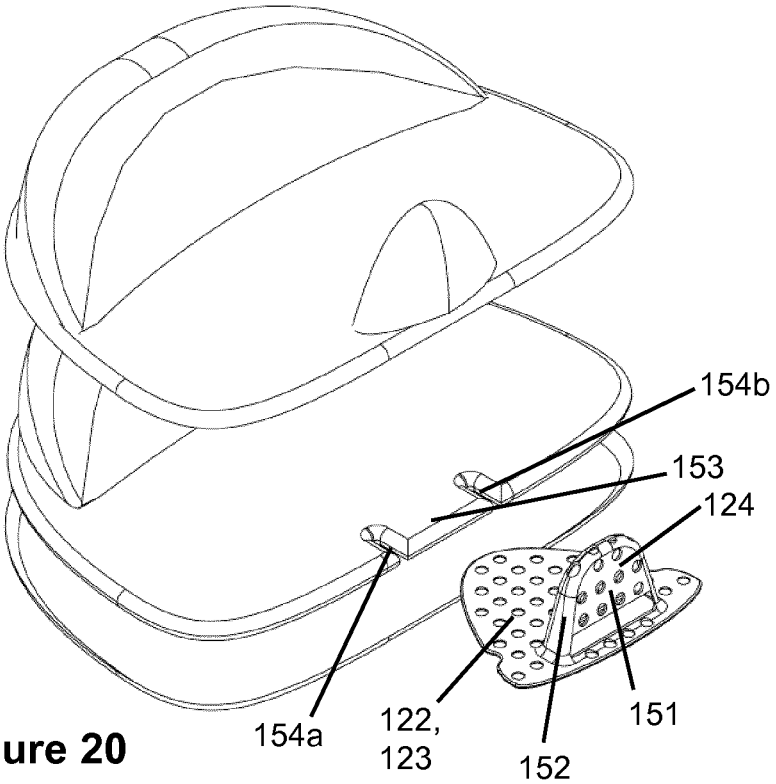
FIG. 20 is an expanded view of the infant portion in FIG. 19.

The comfort apparatus 1 is modular, having multiple different separable components. In addition, the elongate cushion apparatus 5 is itself modular. The elongate cushion apparatus 5 has a first end 6 and a second end 7. The elongate cushion apparatus 5 has a middle section 8, a first end section 9 and a second end section 10. The first end section 9 terminates in the first end 6 and the second end section 10 terminates in the second end 7. Both the first end section 9 and the second end section 10 are connected to the middle section 8 via a zip and are separable from the middle section 8 by unzipping the zips. Releasable fastening arrangements other than zips, such as buttons, hook-and-eye arrangements, and/or pins may be used. The first end section 9 is also connectable to the second end section 10 via a zip as shown in FIGS. 7 and 8. The elongate cushion apparatus 5 also has a fabric flap covering which extends over and conceals the zips in use (not shown). When the first end section 9 is connected to the second end section 10 it provides a pillow of an arcuate shape that can be used to support an infant sitting in an upright position, as shown in FIGS. 8 and 9.

The middle section 8 is elongated, linear and cylindrical. The middle section 8 terminates in a cross-section that is geometrically similar to the cross-section of the first end section 9 and the second end section 10 where the first end section 9 and the second end section 10 are connectable to the middle section 8. The first end section 9 and the second end section 10 are curved such that a portion 11*a*, 11*b* of the first end section 9 and the second end section 10 is substantially orthogonal to the longitudinal axis of the middle section 8 when the first end section 9 and the second end section 10 are connected to the middle section 8 respectively. The cross-sectional area of the first end section 9 and the second end section 10 is inconsistent along their lengths. The first end section 9 and the second end section 10 has a smaller cross-sectional area where the first end section 9 and the second end section 10 are connectable to the middle section 8 and a larger cross-sectional area at the first end 6 and the second end 7. Specifically, the cross-sectional area of the first end section 9 and the second end section 10 increases from where the first end section 9 and the second end section 10 are connectable to the middle section 8 to the first end 6 and second end 7 respectively. The first end 6 and second end 7 have a substantially elliptical cross-section whereas the ends connectable of the middle section 8 are substantially circular.

The comfort apparatus 1 has an infant portion 12 which is sized to support the entire body of an infant. The infant portion 12 has an infant support and safety arrangement 2 and a barrier 3. The infant support and safety arrangement 2 is wedge-shaped and crescent shaped. It further has an upright portion 13 that is vertical and defines an outermost wall of the comfort apparatus 1. The upright portion 13 is also arcuate and variable in height. The infant support and safety arrangement 2 has two opposing endpoints 14*a*, 14*b* and the upright portion 13 has its greatest height midway between the opposing endpoints 14*a*, 14*b*. The upright portion 13 increases in height from the upright support end points 14*a*, 14*b*. The infant portion 12 has a support mat 16 for supporting an infant. The support mat 16 is sized to accommodate the entirety of the body of an average 18-month-old infant. The infant support and safety arrangement 2 has a sloping portion 15 extending downwards from the upright portion 13 the support mat 16. The upright portion 13 and the sloping portion 15 are formed together as a single unitary component. In use, an infant will be positioned between the infant support and safety arrangement 2 and the barrier 3, the sloping portion 15 providing support and comfort to the infant.

The infant support and safety arrangement 2 has an infant support and safety arrangement cover 17 which is made from a soft fabric. The infant support and safety arrangement cover 17 extends over the upright portion 13 and the sloping portion 15. The support mat 16 is soft and has a cushioning layer 18 and a protective layer 19. The protective layer 19 is formed from 100% polypropylene fibre and extends around and envelops the cushioning layer 18. The protective layer 19 has an upper protective layer 20*a* and a lower protective layer 20*b*. The upper protective layer 20*a* is in contact with the infant support and safety arrangement 2. The support mat 16 has an even surface and is roughly oval in shape. The support mat 16 further has an edge which defines a perimeter 21 and the infant support and safety arrangement 2 is shaped such that the upright portion 13 is aligned with the perimeter 21 of the support mat 16.

The barrier 3 extends upwards from the support mat 16 and it is positioned near an opposing portion of the perimeter 21 to the location of the infant support and safety arrangement 2. The barrier 3 is rigid and has a barrier support arrangement 22 that provides form and rigidity to the barrier 3. The barrier support arrangement 22 is located within the support mat 16 in an interlocking arrangement therewith. The barrier support arrangement 22 has a flat portion 23. The flat portion 23 rests on the lower protective layer 20*b* of the support mat 16. The barrier support arrangement 22 has an upwardly extending portion 24 which extends orthogonally from the surface of the support mat 16 and from the flat portion 23. The upwardly extending portion 24 is formed with the flat portion 23 and the flat portion 23 is located between the cushioning layer 18 and the lower protective layer 20*b*. The infant portion 12 comprises a pocket 70 for receiving the flat portion 23 of the upwardly extending portion 24. The flat portion 23 further has two grooves 71 sized to accommodate the dimensions of the pocket 70 for locating and retaining the flat portion 23 within the pocket 70. The barrier support arrangement 22 provides a fin-shaped shaped form to the barrier 3. The barrier support arrangement 22 is formed from a plastic, perforated material. The cushioning layer 18 has an aperture 26 for accommodating the barrier support arrangement 22. The barrier 3 further has a barrier support arrangement cover 25, the barrier support arrangement cover 25 being a soft material that is located over the barrier support arrangement 22. An additional cover 27 is provided by the outer protective layer 20*a* of the support mat 16.

The support mat 16 and the parent support and comfort apparatus 4 are joined by a distance-adjustable joining arrangement 28 which prevents the support mat 16 and the parent support and comfort apparatus 4 from moving substantially apart when in use. The distance-adjustable joining arrangement 28 has a joining mat 29 extending from the parent support and comfort arrangement 28 to the support mat 16. In use, the adult lays on top of the joining mat 29. The distance between the support mat 16 and the parent support and comfort apparatus 4 can be altered by altering where on the joining mat 29 the support mat 16 and/or the parent support and comfort apparatus 4 are connected. The parent support and comfort apparatus 4 is separable from the support mat 16, this is done by separating the parent support and comfort apparatus 4 and/or the support mat 16 from the joining mat 29. The parent support and comfort apparatus 4 is joined to the joining mat 29 via a zip and the support mat 16 via a series of snap fasteners as described in further detail below in relation to the second embodiment of the invention. The distance between the support mat 16 and the parent support and comfort apparatus 4 can be adjusted by folding the joining mat 29 under the support mat 16 and/or under then parent support and comfort apparatus 4. Additionally or alternatively, the distance may be adjusted by altering the series of snap fasteners that are engaged with the support mat. The joining mat 29 is rollable such that it can be rolled for storage.

The comfort apparatus 1 has a storage arrangement 30 for storage of muslins, toys and other items, the storage arrangement 30 optionally having a zipped pocket 31 located on the parent support and comfort apparatus 4.

In FIGS. 15 to 20 there is shown a second embodiment of a modular comfort apparatus indicated generally by the reference numeral 101. The comfort apparatus 101 has a parent support and comfort arrangement 104 and an infant portion 112 (see FIG. 19), with a barrier 103 and a support mat 116. The support mat 116 has a cushioning layer 118 and a substantially squared portion 150*a*, 150*b* at either side of the barrier 103. This provides substantial space to support the head of an infant when the infant portion 112 is being used for breastfeeding. The barrier 103 has a barrier support arrangement 122 having a flat portion 123 and an upwardly extending portion 124. The upwardly extending portion 124 has a first face section 151, a second face section (not shown), and a side section 152 extending therebetween. The side section 152 extends upwards from the flat portion 123 but not the first face section 151 or the second face section, which are supported by the side section 152. This defines a region below the first face section 151 and the second face section wherein a portion 153 of the cushioning layer 118 is inserted. The cushioning layer further comprising grooves 154*a*, 154*b* for accommodating the side section 152 of the upwardly extending portion 124. This further prevents movement of the barrier support arrangement 122 at least in a vertical direction.

The comfort apparatus 101 has a joining mat 129 which is substantially square in shape and further has a neck strap 155 thus enabling the joining mat 129 to be used as a privacy cover for breastfeeding. The comfort apparatus 101 has a series of snap fasteners 156, each snap fastener having a female component situated on the joining mat 129 and a male component on the underside of the infant portion (not shown). The joining mat 129 has three, spaced apart rows of four snap fastener female components and the underside of the infant portion 112 has a single row of four snap fastener male components. The distance between the infant portion 112 and the parent support and comfort arrangement 104 can be adjusted by changing the row of snap fastener female components on the joining mat 129 that are engaged with the snap fastener male components on the underside of the infant portion 112. The parent support and comfort arrangement 104 further has a pocket 157 with a centered stitch 158. This prevents the pocket 157 from sagging.

In use, an infant can lie on the support mat 16 and a mother can lie laterally on the joining mat 29 and position her head and legs on or around the parent support and comfort apparatus 4. The mother can place her head on the first end section 9 and place the second end section 10 between her legs. The second end section 10 or the middle section 8 could alternatively be removed. The curvature of the parent support and comfort apparatus 4 and the support mat 16 enables the mother to curl around the infant and to get close enough to the infant to enable comfortable breastfeeding. The barrier 3 prevents the mother from moving too close to the infant support and safety arrangement 2 prevents the infant from rolling off the support mat 16. The mother can therefore safely and comfortably breastfeed the infant. The distance between the parent support and comfort apparatus 4 and the barrier 3 can be adjusted as discussed previously. To use the parent support and comfort apparatus 4 as a support for an infant when sitting upright, or as a support for an infant when being held by the mother during breastfeeding, the parent support and comfort apparatus 4 is first removed from the joining mat 29 by unzipping the support mat 16. The first end section 9 and second end section 10 are then removed from the middle section 8 by unzipping them. Then the first end section 9 is then joined to the second end section 10 by zipping them together. This forms an arcuate pillow as shown in FIGS. 8 and 9. The arcuate pillow can be set on a surface and an infant can be placed in the middle, either with the infant's back abutting the cushion, thereby using it as a lounger, or the infant's front, thereby using it is a support for "tummy time". The arcuate pillow may also be placed around the waist of a breastfeeding mother and the infant can be set on the pillow, supporting the weight of the infant as the mother breastfeeds. The middle section 8 can also be used as a support, by placing it in an underarm position, and the infant can be supported in the underarm/rugby-ball hold, which is often used with small or pre-term babies.

Various modifications will be apparent to those skilled in the art. For example, the infant portion 12 may or may not have an infant support and safety arrangement 2 or a barrier 3.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the values is more highly preferred than the other, is to be construed as an implied statement that each intermediate value of the parameter, lying between the more preferred and the less preferred of the alternatives, is itself preferred to the less preferred value and also to each value lying between the less preferred value and the intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. A comfort apparatus for use by a parent and an infant, the comfort apparatus comprising a parent support and comfort means, the parent support and comfort means comprising an elongate cushion apparatus, wherein the elongate cushion apparatus comprises a middle section, a first end section and a second end section, and wherein the first end section and/or the second end section are separable from the middle section, wherein the comfort apparatus further comprises an infant portion and wherein the infant portion comprises a support mat for supporting the infant, an infant support and safety means for supporting an infant and preventing the infant from falling out of the infant portion, and a barrier for preventing the parent from rolling onto the infant when in use, the barrier and the infant support and safety means being spaced apart defining a space therebetween, and wherein the support mat and the parent support and comfort means are releasably joinable to one another by a joining means or are joined by a joining means.

2. The comfort apparatus as claimed in claim 1, wherein the parent support and comfort means is sized such that it is operable to support both the head and legs of a parent simultaneously.

3. The comfort apparatus as claimed in claim 1, wherein the infant portion is sized to accommodate all of the body of an infant lying on the infant portion.

4. The comfort apparatus as claimed in claim 1, wherein the joining means is adapted to be releasably fixable to a parent such that it can be used as a privacy cover when breastfeeding.

5. The comfort apparatus as claimed in claim 4, wherein the joining means comprises a neck strap such that it can be used as a cover when breastfeeding.

6. The comfort apparatus as claimed in claim 1, wherein the infant support and safety means is substantially wedge-shaped.

7. The comfort apparatus as claimed in claim 6, wherein the infant support and safety means is substantially crescent shaped.

8. The comfort apparatus as claimed in claim 1, wherein the barrier comprises a barrier support means.

9. The comfort apparatus as claimed in claim 8, wherein the barrier comprises a barrier support means cover.

10. The comfort apparatus as claimed in claim 9, wherein the barrier support means comprises a base portion and an upwardly extending portion that extends upwardly from the base portion.

11. The comfort apparatus as claimed in claim 8, wherein the infant portion comprises a means for locating the barrier support means relative to the support mat.

12. The comfort apparatus as claimed in claim 11, wherein the means for locating the barrier support means comprises a retaining arrangement such as a strap, pocket or hook-and-loop fasteners operable to receive and/or retain at least a part of the barrier support means on the infant portion.

13. The comfort apparatus as claimed in claim 10, wherein the support mat comprises a cushioning layer and wherein the infant portion comprises a protective layer, wherein the protective layer envelops the cushioning layer.

14. The comfort apparatus as claimed in claim 13, wherein the base portion of the barrier support means has a flat portion and wherein the flat portion is located between the cushioning layer and the protective layer.

15. The comfort apparatus as claimed in claim 14, wherein the cushioning layer is shaped to accommodate the barrier support means, and wherein the cushioning layer comprises one or more grooves or an aperture for accommodating the barrier support means.

16. The comfort apparatus as claimed in claim 15, wherein the infant portion comprises a pocket for receiving the flat portion, the flat portion further having two grooves sized to accommodate the dimensions of the pocket for locating and retaining the flat portion within the pocket.

17. The comfort apparatus as claimed in claim 1, wherein the support mat is shaped to support the head of an infant when the comfort apparatus is being used for feeding.

18. The comfort apparatus as claimed in claim 1, wherein the joining means is adjustable such that the distance between the parent support and comfort means and the infant portion can be adjusted.

19. The comfort apparatus as claimed in claim 1, wherein the infant portion and/or the parent support and comfort means are joined to the joining means via a zip, buttons, snap buttons or fasteners, hook-and-eye arrangements, adhesives and/or pins.

20. The comfort apparatus as claimed in claim 19, wherein the distance between the infant portion and the parent support and comfort means can be altered by altering where on the joining means the infant portion and/or the parent support and comfort means are connected.

* * * * *